US008022160B2

(12) United States Patent
Dirks et al.

(10) Patent No.: US 8,022,160 B2
(45) Date of Patent: Sep. 20, 2011

(54) PROCESS FOR MAKING A MONOFILAMENT-LIKE PRODUCT

(75) Inventors: Christiaan H P. Dirks, Dilsen (BE); Joseph A. P. M. Simmelink, Sittard (NL)

(73) Assignee: DSM IP Assets B.V., Heerlen (NL)

( * ) Notice: Subject to any disclaimer, the term of this patent is extended or adjusted under 35 U.S.C. 154(b) by 797 days.

(21) Appl. No.: 11/665,003

(22) PCT Filed: Oct. 14, 2005

(86) PCT No.: PCT/EP2005/011172

§ 371 (c)(1),
(2), (4) Date: Feb. 26, 2008

(87) PCT Pub. No.: WO2006/040190

PCT Pub. Date: Apr. 20, 2006

(65) Prior Publication Data

US 2009/0012251 A1 Jan. 8, 2009

(30) Foreign Application Priority Data

Oct. 14, 2004 (EP) ..... 04077833

(51) Int. Cl.
*C08F 110/02* (2006.01)
*B29C 55/00* (2006.01)
*D02G 3/02* (2006.01)

(52) U.S. Cl. ..... 526/348.1; 528/502 B; 528/502 C; 428/373; 264/291

(58) Field of Classification Search ..... 526/348.1; 528/502 B, 502 C; 428/373; 264/210.2, 264/291

See application file for complete search history.

(56) References Cited

U.S. PATENT DOCUMENTS

| | | | | |
|---|---|---|---|---|
| 5,135,804 | A * | 8/1992 | Harpell et al. | 442/189 |
| 6,148,597 | A * | 11/2000 | Cook | 57/287 |
| 6,183,834 | B1 | 2/2001 | van der Loo | |
| 6,448,359 | B1 | 9/2002 | Kavesh | |
| 7,584,596 | B2 | 9/2009 | Nakanishi | |

FOREIGN PATENT DOCUMENTS

| | | |
|---|---|---|
| JP | 2007-517992 | 7/2001 |
| JP | 2002-339184 | 11/2001 |
| JP | 2003-528994 | 9/2003 |
| JP | 2005-76149 | 3/2005 |
| JP | 2007-522351 | 8/2007 |
| WO | 00/24811 | 5/2000 |
| WO | 01/73173 | 10/2001 |
| WO | WO 2004/033774 A1 * | 4/2004 |
| WO | WO 2005/066400 A1 | 7/2005 |
| WO | WO 2005/066401 A1 | 7/2005 |

OTHER PUBLICATIONS

International Search Report mailed Jan. 27, 2006 in PCT/EP2005/011172.
Written Opinion mailed Jan. 27, 2006 in PCT/EP2005/011172.

* cited by examiner

*Primary Examiner* — Fred M Teskin
(74) *Attorney, Agent, or Firm* — Nixon & Vanderhye P.C.

(57) ABSTRACT

The invention relates to a process for making a monofilament-like product from a precursor containing at least one strand of fibers made from ultra-high molar mass polyethylene, comprising a) exposing the precursor to a temperature within the melting point range of the polyethylene for a time sufficient to at least partly fuse adjacent fibers and b) simultaneously stretching the precursor, wherein the precursor is mechanically compressed during fusing. The monofilament-like product thus made has a smoother surface appearance, and improved abrasion resistance, for example a reduced tendency to pilling during use as fishing line, than known similar products; making it very suitable for use as fishing line and the like. The invention further relates to a monofilament-like product obtainable by said process, and to semi-finished and end-use products comprising said monofilament-like product.

13 Claims, 1 Drawing Sheet

PROCESS FOR MAKING A MONOFILAMENT-LIKE PRODUCT

This application is the US national phase of international application PCT/EP2005/011172 filed 14 Oct. 2005 which designated the U.S. and claims benefit of EP 04077833.4, dated 14 Oct. 2004, the entire content of which is hereby incorporated by reference.

FIELD

The invention relates to a process for making a monofilament-like product from a precursor containing at least one strand of fibres made from ultra-high molar mass polyethylene, comprising a) exposing the precursor to a temperature within the melting point range of the polyethylene for a time sufficient to at least partly fuse adjacent fibres and b) simultaneously stretching the precursor.

The invention further relates to a monofilament-like product obtainable by said process, and to the use of said monofilament-like product for making various semi-finished products and end-use products.

BACKGROUND AND SUMMARY

Such a process is known from EP 0740002 B1. In this patent publication a process for making a fishing line from yarns of filamentous materials is described, wherein a line made from braided, twisted, or twisted and plied yarns of gel spun polyethylene filaments is exposed to a temperature within the melting point range of said polyethylene for a time sufficient to at least partially fuse adjacent filaments while stretching said line at a stretching ratio within the range from 1.01 to 2.5. Applying such stretch ratio to the precursor during the heat exposure is needed in order to keep the filaments under elongational tension, so as to prevent decrease of the strength of the product as a result of thermal molecular relaxation processes. The yarns applied in this process are high-strength continuous multi-filament yarns, more specifically such yarns made by so-called gel spinning of ultra-high molar mass polyethylene (UHMWPE), for example yarns commercially available under the trademarks Spectra® or Dyneema®. The monofilament-like products thus obtained in EP 0740002 B1 are stated to show less fraying and to have lower surface friction than corresponding braided or twisted lines, while still showing favourable high strength.

In WO 2004/033774 A1 a similar fusion process is applied to a precursor containing a spun yarn made from UHMWPE staple fibres as strand.

Fishing lines are generally monofilaments made from synthetic polymers, having a round, firm structure that allows convenient handling for bait casting, spinning, and spin casting. Such monofilament lines generally have a stiff nature and smooth surface, which combine to reduce drag during the cast and enable longer casts while providing better release from fishing reels. Braided lines containing a multitude of filaments are less suited for fishing lines, because they have a tendency to fray at the end of the line, may entrap water, present an outer surface that is vulnerable to snags and entanglement, and have an opaque appearance that is too visible below water.

The process known from EP 0740002 B1 allows making monofilament-like fishing lines from braided or twisted lines made from polyethylene multi-filaments yarns, which lines have specific advantages over braided lines. The performance of such fused lines also compares favourable with that of a conventional monofilament made from e.g. polyamide by melt extrusion in view of is higher tensile strength (or tenacity) and stiffness. Such thermally fused lines further have an advantage over monofilament-like products made by bonding together multiple filaments with a bonding agent, for example by a melt impregnating step with a thermoplastic polymer like LDPE as described in U.S. Pat. No. 5,601,775, in that they generally show higher tenacity; the strength of the constituting fibres is not 'diluted' by the presence of a polymeric bonding agent.

A disadvantage of such fused filamentous lines is their tendency to show pilling: as a result of abrasion of the line, e.g. by moving along guiding members during casting and fishing, surface fused filaments may delaminate, and freed filamentous material rearranges itself on the line into small pills. It is clear that a line showing such pilling will perform less well in casting etc. Therefore, it is desirable to have a monofilament-like product made from a precursor containing fibres made from UHMWPE that combines high tensile properties and knot strength with improved resistance to abrasion, especially showing little pilling.

It is therefore an object of the present invention to provide a process for making a monofilament-like product that does not, or at least to a reduced extent, show said disadvantage.

This object is achieved according to the invention with a process for making a monofilament-like product from a precursor containing at least one strand of fibres made from ultra-high molar mass polyethylene, comprising a) exposing the precursor to a temperature within the melting point range of the polyethylene for a time sufficient to at least partly fuse adjacent fibres and b) simultaneously stretching the precursor, wherein the precursor is mechanically compressed during fusing.

With the process according to the invention a high-strength monofilament-like product can be made from UHMWPE fibres, which product has a smoother surface appearance, and improved abrasion resistance, for example a reduced tendency to pilling during use as fishing line, than known similar products; which makes it very suitable for use as fishing line and the like. A further advantage of the process according to the invention is that very thin monofilament-like products can be made.

The monofilament-like product obtained by the process according to the invention has a pleasant touch or feel and can be easily handled and knotted, and shows very high knot strength and knot strength efficiency. With the process according to the invention it is also possible to make a line with monofilament-like surface appearance, but with flexibility more like a multifilament yarn construction. Such product typically has a sheath-core structure; that is it has a non-porous sheath of fused filaments and a core of mainly filamentous character. A further advantage of the process according to the invention is that it can be applied with high efficiency to twisted and/or air-entangled multifilament yarns, to braided multifilament precursors, as well as to precursors based on short staple fibres; and that it is possible to control formation of said sheath-core structure.

DETAILED DESCRIPTION

Figure 1:
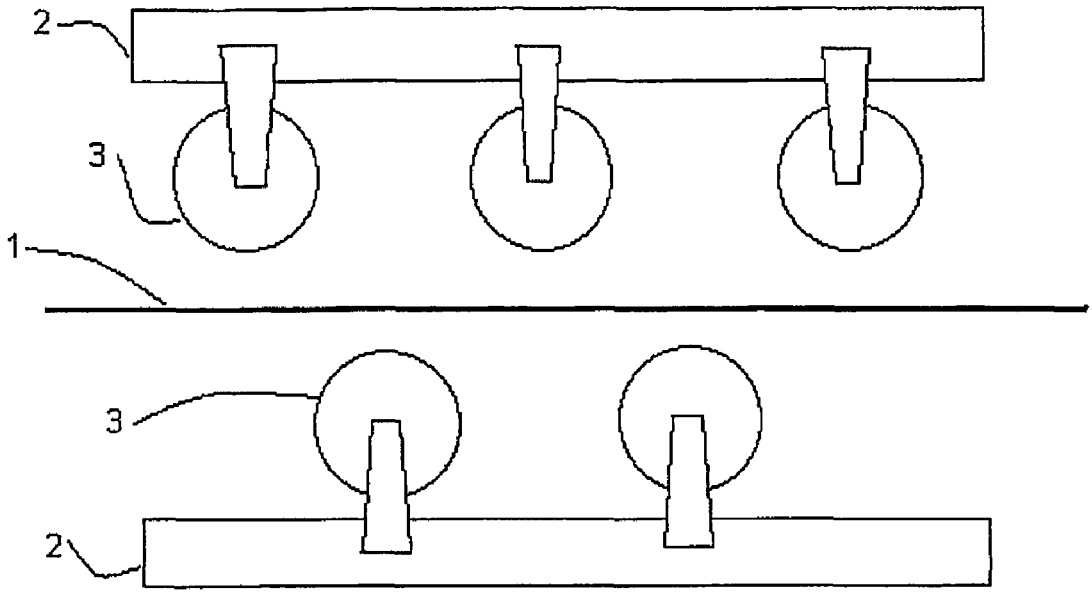
FIGS. 1(*a*) and 1(*b*) schematically depict two frame parts with attached rollers as guiding members in open and (semi-) closed positions, respectively.
Figure 1:
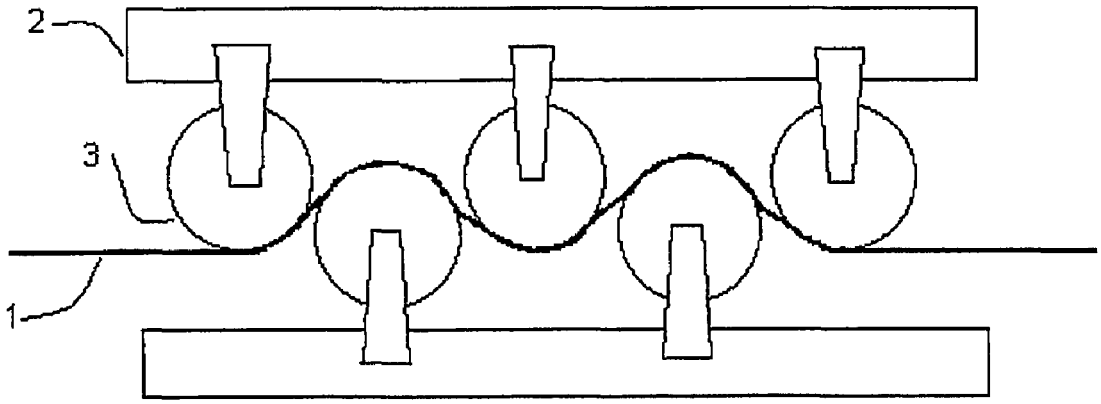

With the process according to the invention a monofilament-like product is made from a multifilament precursor. A monofilament-like product is understood to be a product that has an appearance and feel more resembling that of a monofilament than that of multi-filament yarn or cord, but which actually is made from a multitude of continuous or short filaments that typically have a diameter of less than about 50, often less than 30 micrometer. The monofilament-like product may have a diameter that varies within a wide range, e.g. from about 0.05 up to several millimetres. For products with a non-round cross-section the linear density or titer would be a more suitable unit. The titer of the monofilament-like product may vary from e.g. 5 dtex up to several thousands dtex. A precursor is herein understood to be an article of indefinite length containing at least one strand of fibres made from ultra-high molar mass polyethylene, for example one or more multifilament yarns of titer 25-2000 dtex, and is used as feed or starting material in the process according to the invention. A suitable precursor can be in the form of for example a braided cord, a plied and twisted yarn, cord or rope comprising a number of strands containing UHMWPE fibres, but may also be a single-strand spun yarn. A strand of fibres made from UHMWPE is understood to be a fibrous article like a yarn, and includes both multifilament yarns based on continuous filaments, as well as spun yarn made from short staple fibres. The precursor contains predominantly UHMWPE fibres, i.e. 50 or more mass % of the total amount of fibres, preferably the precursor contains at least 70, 80, 90 mass % of UHMWPE fibres, or even substantially consists of only such fibres. This results in a line with high mechanical performance, especially high tenacity.

Ultra-high molar mass polyethylene, also referred to as ultra-high molecular weight polyethylene and abbreviated UHMWPE, has an intrinsic viscosity (IV) of more than 5 dl/g. The IV is determined according to method PTC-179 (Hercules Inc. Rev. Apr. 29, 1982) at 135° C. in decalin, the dissolution time being 16 hours, with DBPC as anti-oxidant in an amount of 2 g/l solution, and the viscosity at different concentrations is extrapolated to zero concentration. Intrinsic viscosity is a measure for molar mass (also called molecular weight) that can more easily be determined than actual molar mass parameters like $M_n$ and $M_w$. There are several empirical relations between IV and $M_w$, for example $M_w=5.37\times10^4$ $[IV]^{1.37}$ (see EP 0504954 A1), but such relation is highly dependent on molar mass distribution. UHMWPE filament yarn can be prepared by spinning of a solution of UHMWPE into a gel fibre and drawing the fibre before, during and/or after partial or complete removal of the solvent; that is via a so-called gel-spinning process. Gel spinning of UHMWPE is well known to the person skilled in the art; and described in numerous publications, including EP 0205960 A, EP 0213208 A1, U.S. Pat. No. 4,413,110, GB 2042414 A, EP 0200547 B1, EP 0472114 B1, WO 01/73173 A1, and Advanced Fiber Spinning Technology, Ed. T. Nakajima, Woodhead Publ. Ltd (1994), ISBN 1-855-73182-7, and references cited therein. Gel spinning is understood to include at least the steps of spinning at least one filament from a solution of ultra-high molecular weight polyethylene in a spin solvent; cooling the filament obtained to form a gel filament; removing at least partly the spin solvent from the gel filament; and drawing the filament in at least one drawing step before, during or after removing spin solvent. In view of solubility of the UHMWPE and processability of the solution, the UHMWPE preferably has an IV of at most 40 dl/g. Suitable spin solvents include for example paraffins, mineral oil, kerosene or decalin. Spin solvent can be removed by evaporation, extraction, or by a combination of evaporation and extraction routes.

The process according to the invention comprises the step of exposing the precursor to a temperature within the melting point range of the UHMWPE for a time sufficient to at least partly fuse adjacent fibres. The conditions of this fusion step are chosen such, that the temperature and time of exposure are sufficient to soften especially a surface layer of the fibres and to allow them to fuse at least partly, especially those fibres at the outer surface of the precursor line. The melting point range of the UHMWPE is the temperature range between the peak melting point of a non-oriented polymer and the peak melting point of a constrained highly-oriented UHMWPE fibre, as determined by DSC analysis using a scan-rate of 20° C./min. For UHMWPE filaments, typically showing a melting point range of 138-162° C., the temperature is preferably within the range from about 150° C. up to about 157° C. Residence times during which the precursor is exposed to the fusion temperature may vary within a broad range, but are typically within the range from about 5 seconds to about 1500 seconds. Although higher temperatures tend to enhance the fusion process, care should be taken not to apply too high a temperature or too long a time as this may cause loss in strength of the product, resulting from e.g. partial melting or other molecular relaxation effects within the core of the filaments. An (step-wise) increasing temperature profile offers advantages regarding such temperature and fusion control. Suitable means for performing this process include ovens with accurate temperature control and drawing means; which are known to the skilled person, as well as alternative means for performing the process according to the invention.

During the fusion process, the appearance of the precursor may typically change from an initial, opaque appearance, for example of white colour, into a translucent, milky, or even substantially transparent surface appearance of the product, depending on the degree of fusion and type of precursor material. The light transmission of the product increases with increased degree of fusion between fibres. Such an increase in translucency or light transmission is a definite advantage for application as underwater fishing-lines. The natural white colour may also have been adjusted by addition of colorants.

For a monofilament-like product showing low end fraying and little surface pilling it suffices that an outer surface layer of the line is at least partly fused, as seen by increase in translucency. A higher degree of fusion, e.g. also binding filaments in more inner parts of a precursor or strand, however, is preferred for making a product with a higher bending stiffness and higher transparency, that is with still more monofilament-like characteristics.

With the process according to the invention it is possible to make an outer fused surface, layer that is substantially non-porous in a controlled way by mechanically compressing the filamentous precursor during thermal fusion, e.g. by applying a force around the precursor on its surface. Such product shows a smooth surface with enhanced abrasion resistance, e.g. little tendency to delamination effects like pilling. The fused surface layer may enclose a core that still has mainly filamentous character, providing more flexibility to the product. The degree of fusion can be adjusted by varying exposure temperature and/or time, and especially by varying the force applied for compressing in the process according to the invention.

The degree of fusion can be determined on the product obtained, for example by visual evaluation, e.g. with the naked aye or by using an optical or electron microscope, of the surface and/or a cross-section; or by measuring mechanical properties like strength or stiffness. Another possibility is to determine the amount and rate of absorption of a coloured liquid, e.g. from a marker, as described in EP 0740002 B1.

The degree of fusion can also be derived from a test, wherein the loaded product is abraded over a surface, e.g. a metal or ceramic rod, and the number of movements is determined until the monofilament-like product disintegrates into its constituting filaments, or starts to show pilling as a result of breaking of some of the filaments.

It has been found that if a certain compressive force is applied around the surface of the precursor thermal fusing efficiency is improved and a more homogeneous fusing of filaments occurs, especially in the outer layer. This results in a smoother surface appearance, and improves abrasion resistance of the monofilament-like product. By applying compressive forces also the (cross-sectional) geometry of the product can be influenced. Substantially equal forces applied to all surface area during fusion will likely result in an almost round product; whereas non-homogeneously distributed forces would result in products having non-round, for example oblong cross-sections.

In a preferred embodiment of the process according to the invention the precursor is compressed during fusing by passing the precursor over at least one guiding member having a surface comprising a groove or slit, in such way that substantially the whole surface of the precursor contacts the member inside a groove at least one time, and a force is exerted substantially around the whole precursor. Preferably, the groove is V-shaped with a top opening of such dimension that allows easy entry of a filamentous precursor that may have been spread to some extent, and with the bottom of the groove having such dimension and geometry to define the desired dimension and shape of the monofilament-like product. The guiding member may be a static cylindrical bar, but is preferably a freely rotating wheel or roller, or a driven roller. The force exerted on the line can be adjusted by changing the tension in the line, by adjusting the diameter of a cylindrical member, and/or by changing the length of contacting surface (or contacting angle) between line and member. The skilled person can find desirable combinations by some experimentation. An additional advantage of this way of operating the process according to the invention is, that by choosing the geometry of the groove, the cross-sectional geometry of the monofilament-like product can be controlled, and be kept be constant during production over great length of the product. For example, by applying a V-shaped groove with a rounded bottom, the radius of which is adjusted to the precursor and desired diameter of the product, a cylindrical or oval product can be made; but also other geometries are possible. The angle of the groove (angle virtually made by its side walls) is not critical, and can vary between wide limits. A suitable angle appeared to be about 50-70°. The dimensioning of a groove may also be different for subsequent members in case more than one guiding member is applied, for example the radius of a rounded bottom may step-wise decrease so as to further compress the line. It is found that applying 2 or more members gives more consistent results, more preferably at least 3, 4, 5, 6 or even 7 members are used. Applying an uneven number of guiding members has the advantage that the line can follow a virtually straight path before and after passing the members, which allows simpler oven design and operation. In a specifically preferred embodiment, an uneven number of guiding members is applied, which members are mounted in two groups (number of members differing 1; e.g. 3 and 2, 4 and 3) on two frame parts, which parts can move relative to each other to an open and a closed position. In the open position, the line can be easily passed between the members; whereas upon subsequent closing the line will contact all members. This embodiment allows easy start up of the fusing (and drawing) process, and is further illustrated in FIG. 1.

FIG. 1(*a*) schematically depicts two frame parts (2) with attached rollers as guiding members (3) in open position, with line (1) freely passing; whereas FIG. 1(*b*) shows a (semi-) closed position, with the line contacting the rollers in the groove present on its surface. Note that by bringing the frame parts more closely together, the contacting length of the line (1) with the guiding members (3) can be further increased.

Preferably, the (surface of the) guiding member is also controlled at a temperature within the melting point range of the polyethylene, so as to better control the degree of fusion and the geometry of the product, for example by placing the members inside a temperature-controlled oven used for drawing and fusing. In a special embodiment, the member is of slightly higher temperature, for example 1 or 2 degrees, than the temperature setting (of for example the oven applied) for drawing and fusing. The advantage hereof is that fusing is even more efficient and that a well-defined fused outer skin can be made.

In another embodiment of the process according to the invention the precursor is mechanically compressed during fusing by guiding and pulling the precursor through an opening having a surface area at its smallest point of at most equal to the total cross-sectional area of the precursor, e.g. the sum of all filament cross-sectional areas, thus pressing the filaments in the precursor together. Examples of suitable openings include a conical die, a ring, or a set of rings with decreasing size of openings. The above-indicated preferences for geometry, temperature setting etc. of grooved guiding members apply likewise. Pulling a precursor through an opening, however, could present some difficulties in production regarding starting-up, changing desired product dimensions etc. Some of these drawbacks may be reduced by using an opening that is formed by at least two movable complementary parts, and only forming the enclosed opening when the drawing process has started running, taking care that not part of the precursor filaments are trapped upon bringing the parts together.

The monofilament-like product obtained by above process comprising mechanical compressing during fusion, shows a substantially non-porous surface layer, as seen by optical or electron microscopy, and has cross-sectional geometry and area that show little variation over the length of the product. Depending on the applied conditions, inner filaments may or may not have been fused.

The fibres applied in the precursor are preferably made from a linear polyethylene, that is from a polyethylene with less than one side chain per 100 carbon atoms, and preferably less than one side chain per 300 carbon atoms; a side chain or branch containing at least 10 carbon atoms. The linear UHMWPE preferably contains less than 1 mol % of comonomers, such as alkenes, more preferably less than 0.5 or even less than 0.3 mol %. The advantage of using such homopolymer is that a higher draw ratio can be applied, resulting in better tensile properties of the product.

In addition to the UHMWPE polymer the fibres may contain small amounts, e.g. less than 5 mass %, of additives that are customary for such fibres, such as anti-oxidants, spin-finishes, thermal stabilizers, colorants, etc.

Preferably, UHMWPE fibres having an IV in the range 5-25 dl/g are chosen as strand material for the precursor, more preferably in the range 6-20, or even 7-15 dl/g. Although in general a higher IV or molar mass of UHMWPE results in higher mechanical strength attainable for the fibres, application of UHMWPE filaments of relatively low IV in the present process is found to result in a product with further improved resistance to abrasion; that is the so-called pilling effect is reduced (for example less filamentous material visible on the surface of the product during its use as fishing line).

The process according to the invention can be performed with a precursor of various constructions, for example of a braided construction, or a plied (or folded) and twisted construction, with air-entangled multifilaments yarns, as well as with precursors based on short staple fibres. Suitable constructions made from continuous filaments are for example described in EP 0740002 B1, whereas suitable spun yarn compositions and constructions are described in WO 2004/033774 A1. A distinct advantage of the process according to the invention is that products with very good performance can be made from twisted and/or air-entangled yarns as precursor, even from very low titer yarns; whereas the known process cannot be applied to such precursors, or at least results in products with less good performance. Applying twisted and/or air-entangled precursors of titers higher than about 200 dtex rather than braided or spun yarn constructions has the advantage that the precursor and monofilament-like product can be made easily and cost-effectively. If low titer products are desired, a precursor of lower titer is to be used, and in such case a precursor based on spun yarn is preferred, in view of economical advantages.

The process according to the invention includes simultaneously stretching the precursor at a draw ratio, also called stretch ratio, of at least 1.0, that way keeping the filaments under tension and preventing that the strength of the product decreases as a result of thermal molecular relaxation processes. Preferably, a draw ratio of at least 1.1, 1.5, 2.0 or more preferably of even at least 2.5, 2.8, or 3.0 is applied to further improve properties, especially tensile strength (both before and after making a knot in the line). In addition, applying a higher draw ratio will lower the titer of the resulting product, and increases production flexibility. Above a certain draw ratio the property enhancing effect levels off or properties may even decrease as result of partly damaging or breaking of fibres. The maximum draw ratio is thus dependent on the type of precursor and its filaments, and is generally at most about 10, or at most 8 or 6.

Preferably, the product obtained with the process according to the invention is cooled while keeping it under tension. This has the advantage that the orientation in the product obtained during fusing and stretching, on both level of filaments and on molecular level, is retained better. Such tension can result from, for example, winding the product into packages subsequent to preceding steps of the process.

The process according to the invention can further comprise a preceding step of pre-treating the precursor, or one or more of the strands therein, in order to enhance inter filament bonding during the fusion step. Such pre-treatment step may include coating the precursor with a component or a composition; scouring the precursor, that is washing-off surface components like spin finishes etc.; or applying a high-voltage plasma or corona treatment, or any combination thereof. Preferably, the precursor comprises UHMWPE fibres that are substantially free from spin finish; meaning no spin finish was applied during their production, or a spin finish present is removed in a pre-treating step. This has the advantage that abrasion resistance of the monofilament-like product is further increased, and that even less pilling is observed during use as fishing line.

In another embodiment the precursor is pre-treated by applying; e.g. by dipping or wetting, an effective amount of a mineral oil (e.g. heat transfer grade mineral oil with an average molar mass of about 250-700), vegetable oil (e.g. coconut oil), or a, preferably non-volatile, solvent for polyethylene; like paraffin. This pre-treatment step may be performed at ambient conditions, or at elevated temperature up to below the melting temperature range of the polyethylene fibre, and may even coincide with stretching and fusing. The advantage of this embodiment step is that the efficiency of the fusing process is further enhanced, that is a higher degree of fusion at the same conditions, or a similar degree at slightly lower temperature, shorter time or less compressive force can be attained. The oil or solvent may further comprise other additives, like colorants or stabilisers. The amount of oil or solvent can vary widely, for example from 0.1 to 25 mass %, based on the UHMWPE fibres. For medical applications preferably no or only very low amounts are applied; for applications like fishing lines preferred amounts are 2-20, more preferably 5-15 mass %.

The process according to the invention can further comprise a step wherein a coating composition is applied to the product after fusing and drawing to form a coating layer. Such coating composition may comprise a typical spin finish to allow easier handling and processing of the product in subsequent operations; a compound or composition to control adhesion during subsequent making of composite articles comprising the product; or a binder composition that further enhances integrity and strength of the product. Typical examples of the latter include polyurethane or polyolefin-based, like ethylene-acrylic copolymers, binder compositions. The coating composition can be in the form of a solution or a dispersion. Such a composition may further comprise components that further improve the abrasion- or cut-resistance of the monofilament-like product. Examples of components that improve cut-resistant are small particulate particles of high surface hardness, like various mineral or ceramic particles. The coating composition may further comprise other additives, like colorants, stabilisers, etc.

The invention also relates to a monofilament-like product comprising at least partly fused UHMWPE fibres, which product is obtainable by the process according to the invention. The monofilament-like product according to the invention combines high tensile strength and modulus with excellent resistance to abrasion; it can be easily knotted and the knotted product shows high knot strength. This novel monofilament-like product has an abrasion resistance higher than known monofilament-like products comprising at least partly fused UHMWPE filaments. Preferably, the invention relates to a product having a titer of at least 400 dtex, preferably in the range 400-1000 dtex, and an abrasion (or pilling) resistance, of at least 1800, preferably at least 2000 or 2200 cycles. Abrasion resistance is defined as the number of cycles until the sample shows the first pilling, as determined by a procedure, wherein the sample is abraded at room temperature (21±2° C.) by placing it over a stainless steel eyelet of 1.5 mm diameter at an angle of 90°, which eyelet is submersed in water, and subjecting the sample to oscillating movements at a frequency of 0.5 Hz with a stroke-length (length of sample moving over the surface) of 200 mm, with a constant load of 0.5 kg on the sample. Such a product also has a high tensile strength, i.e. of at least 15 cN/dtex, preferably at least 20, 25, 30 or even 35 cN/dtex.

In a special embodiment, the monofilament-like product has a sheath-core structure; that is the product has a substantially non-porous UHMWPE sheath or outer layer, and UHMWPE filaments that show no or hardly fusing inside. The UHMWPE sheath being substantially non-porous is understood to mean that no or hardly any pores or voids can be seen on the surface of the member, e.g. with an optical or electron microscope.

The relative thickness of the substantially non-porous UHMWPE sheath of the product according to the invention may vary between wide limits. It has been found that a sheath layer that is relatively thick in relation to the core comprising UHMWPE filaments, results in a member with reduced flexibility, but this effect will generally be dependent on the size or dimensions of the product; a thin product as such is more flexible and thus less sensitive to a varying thickness of sheath layer. In order to display the desired improved abrasion resistance, the sheath layer preferably has a certain minimum thickness. A suitable minimum thickness for the sheath is found to be on the order of about 20 micrometer, preferably it is at least 25 micron; but the sheath layer may much thicker. The sheath forms at least about 5 mass % of the monofilament-like product, preferably at least 10, 15, 20, 25, or 30 mass %. On the other hand, the sheath forms preferably at most 95 mass %, more preferably at most 90, 80, 70, 60, or even at most 50 mass % for higher flexibility. Although for a low diameter product, e.g. diameter below 150 micrometer, the non-porous sheath may constitute 100% of the product, a higher relative content of UHMWPE filaments showing little fusing is found to be advantageous for optimising strength and knot strength of the product.

The monofilament-like product obtainable by the process according to the invention has a linear density, also referred to as titer, which may vary within wide limits, e.g. from 5 to 15000 dtex. The invention also specifically relates to monofilament-like products made from UHMWPE fibres, and having a titer in the range 5-100 dtex; since such fine products could not be made with known processes. Preferably, the product is made from twisted and/or air-entangled UHMWPE fibres, rather than from braided structures. These products typically are of tenacity of at least 25, preferably at least 30, 35, 38, or even 40 cN/dtex. The maximum strength is not specifically limited by the process, and is also dependent on the type and strength of the precursor. Although the theoretical strength of UHMWPE fibres may even be significantly higher, with the present process monofilament-like products having a tenacity of 55, 60, or even of 65 cN/dtex may be obtained. Such high-strength low-titer products are very suitable for use in medical devices and implants, such as surgical sutures and the like. For such medical applications it is preferred that the product consists essentially of UHMWPE, and contains only minor amounts, e.g. less than 5 mass %, more preferably less than 3 mass % of other components, which components are allowed by the relevant authorities for such applications.

In view of applications like fishing or kite lines, or protective garments and clothing, the titer of the monofilament-like products preferably from 100 to 2000 dtex, even more preferably from 200 to 1600, or from 400 to 1000 dtex.

The invention further relates to the use of the monofilament-like product according to invention for making various semi-finished products and various end-use products, like fishing lines; kite lines; surgical sutures; various fabrics, cords and ropes, composite yarns, and their use in for example cut-resistant articles.

The invention also concerns semi-finished products and end-use products comprising the monofilament-like product according to the invention.

The invention will now be further illustrated by the following experiments.

COMPARATIVE EXPERIMENT A

As precursor (feed) material a twisted and plied construction was applied, which was made from 6 strands of a multifilament gel-spun UHMWPE yarn, having a yarn titer of 224 dtex, a tensile strength of 39 cN/dtex, a tensile modulus of 1250 cN/dtex, with a clockwise twist of 400 turns/m.

The precursor was passed through a bath of liquid paraffin as pre-treatment step, and excess oil was wiped off by passing between non-woven fabrics. The paraffin content was calculated to be about 12 mass % by determining the mass increase upon this step. The precursor was then guided over a first set of driven rollers into an oven, kept at a constant temperature of 153.8° C., with a constant speed of 2 m/min. At the exit of the oven, the line was guided over a second set of driven rollers. The speed of the second rollers was 4.42 m/min and the draw rate in the oven was about 0.8 $min^{-1}$.

The line obtained was somewhat translucent, and showed integrity as monofilament during rubbing between fingers. A cross-section of the line was made and studied with optical microscopy. The surface of the line appears rather irregular; also the cross-sectional dimensions vary slightly over the length of the line, average diameter was about 0.3 mm. Although appearing a monofilament, individual original filaments can still be clearly recognized.

The tensile strength (or strength), the tensile modulus (also modulus) and elongation at break (eab) are defined and determined on multifilament yarns, and on monofilament-like products as specified in ASTM D885M, using a nominal gauge length of the fibre of 500 mm, a crosshead speed of 50%/min and Instron 2714 clamps. For calculation of the strength, the tensile forces measured are divided by the titer, as determined by weighing 10 metres (or another length) of fibre. Elongation is the measured elongation at break, expressed in % of the original length after clamping the specimen.

Abrasion resistance was measured following an in-house developed procedure, wherein the sample is abraded by oscillating movements over a ceramic surface, and the number of cycles is determined until the sample fails (breaks). The number given is the average of at least 5 tests.

Results of tensile and abrasion testing are compiled in Table 1.

EXAMPLE 1

The experiment was performed largely analogous to Comp. Exp. A, be it that the precursor was a twisted and plied construction containing 6 strands of the same multifilament yarn, with a clockwise twist of 270 turns/m, and that additional pressure was exerted to the precursor during fusing. The precursor was fed over the first set of driven rollers into the oven, kept at a constant temperature of 153.5° C., with a constant speed of 6 m/min. At the exit of the oven the line was guided over a second set of driven rollers with constant speed of 12.65 m/min, and the draw rate was about 0.8 $min^{-1}$. Inside the oven, the precursor was passed over 2 freely rotating cylindrical metal rollers of diameter 20 mm, each having a circumferential V-shaped groove with a rounded bottom of 0.2 mm radius in its surface, the precursor line contacting each roller in the groove for about a half circle length.

The measured paraffin content was about 11 mass %, the diameter of the fused line 0.29 mm. Cross-sections studied by optical microscopy appear almost cylindrical and quite regular over the length of the line. In an outer layer of about 30-40 micron boundaries between filaments are diffuse, whereas in the inner part original filaments are clearly visible; indicating a higher degree of fusion between filaments in the outer layer. Examining the surface of the line with an optical microscope revealed no visible pores.

During experiments mimicking sports fishing, pilling was only observed after more than 8 hours, whereas the sample made in the Comp. Exp. already showed pilling after several hours.

Results of further testing are compiled in Table 1, and demonstrate higher tensile properties and markedly increased resistance to abrasion.

TABLE 1

| Experiment | Average diameter (mm) | Tensile properties Strength (cN/dtex) | Modulus (cN/dtex) | Elongation (%) | Abrasion resistance (Number of cycles) |
|---|---|---|---|---|---|
| Comp. Exp. A | 0.30 | 20.4 | 1160 | 2.0 | 6000 |
| Example 1 | 0.29 | 25.2 | 1275 | 2.3 | 127000 |

COMPARATIVE EXPERIMENT B

As precursor material a twisted and plied construction was applied, which was made from 4 strands of a gel-spun UHMWPE multifilament yarn of titer 440 dtex, tenacity 14 cN/dtex, with a clockwise twist of 223 turns/m.

The precursor was passed through a bath of liquid paraffin as pre-treatment step, and excess oil was wiped off by passing between non-woven fabrics. The paraffin content was calculated to be about 13 mass % by determining the mass increase upon this step. The precursor was then passed through 3 subsequent ovens using sets of driven rollers before and after each oven, the ovens were kept at constant temperatures of 151, 152 and 153.2° C., respectively. The speed of the subsequent rollers was 3.1, 5.9, 8.2 and 10.5 m/min, and the draw rate in the ovens was about 0.8, 0.6 and 0.6 $min^{-1}$, respectively. The total applied draw ratio was thus 3.4.

Abrasion resistance, or pilling resistance in this case, was measured following an in-house developed procedure, wherein the sample is abraded at room temperature (21±2° C.) by placing it over a stainless steel eyelet of 1.5 mm diameter at an angle of 90°, which eyelet is submersed in water, and subjecting it to oscillating movements at a frequency of 0.5 Hz with a stroke-length (length of sample moving over the surface) of 200 mm, with a constant load of 0.5 kg on sample, and the number of cycles is determined until the sample shows the first pilling. The number given is the average of at least 5 tests.

Results of tensile and abrasion testing are compiled in Table 2. Knot efficiency (or knot strength retention) is the measured strength after a Palomar knot was applied to the line relative to tensile strength.

EXAMPLE 2

The experiment was performed largely analogous to Comp. Exp. B, be it that additional mechanical pressure was exerted to the precursor during fusing, by passing the line over a set of 5 freely rotating cylindrical metal rollers of diameter 23 mm, each having a circumferential V-shaped groove with a rounded bottom of 0.2 mm radius in its surface, the line contacting the first and last roller in the groove for about a quarter circle length, and rollers 2-4 for about a half circle length (the set of rollers was placed inside the third oven).

The measured paraffin content was about 13 mass %. Cross-sections studied by optical microscopy appear almost cylindrical (about 0.25 mm diameter) and quite regular over the length of the line. Examining the surface of the line with an optical microscope revealed no visible pores, and a very regular smooth surface.

For further comparison, two commercially available 'fused' monofilament-like fishing lines are also tested: Comparative experiment C is the product designated as FireLine® 14# test (6.3 kg/6 lb); which is also a product made by thermally fusing a braided structure made from UHMWPE fibres by the process known from EP 0740002 B1; it has a diameter of about 0.25 mm. The product sold as Spiderwire FUSION 14# test (6.4 kg/6 lb) appears to comprise twisted UHMWPE filaments that have been impregnated/coated with a polyethylene (about 51 mass % based on product), and has a diameter of about 0.28 mm (Comp. exp. D).

Manual and visual evaluation of the samples revealed Example 2 as the line with the smoothest appearance, touch and feel.

Results of further testing are compiled in Table 2, and demonstrate high tensile properties and markedly increased resistance to pilling caused by abrasion. Also knot strength retention is higher than for the other products.

TABLE 2

| Experiment | Titer (dtex) | Tenacity (cN/dtex) | Knot efficiency (%) | Pilling resistance (number of cycles) |
|---|---|---|---|---|
| Comp. Exp. B | 553 | 30.0 | 61.2 | 680 |
| Example 2 | 592 | 31.6 | 76.3 | 2300 |
| Comp. Exp. C | 576 | 31.2 | 57.0 | 1420 |
| Comp. Exp. D | 787 | 11.4 | 62.6 | 1470 |

EXAMPLE 3

A starting UHMWPE yarn containing no spin finish and of properties listed in Table 3 was made by a gel-spinning process as described in WO 2005/066401 A1, and twisted to form the precursor yarn.

Similar to the procedure of Example 2 this precursor yarn was fused into a monofilament-like product, but no paraffin pre-treatment was applied, and the draw ratio in the oven was 1.5 (at 153.6° C.). Without using the set of grooved rollers it did not appear possible to consistently make such a round monofilament line, although a tape-like product of varying dimension and degree of fusion could be made.

The product obtained is very thin, smooth, and being translucent hardly visible with the naked eye. Rubbing between fingers or moving over an edge did not result in delamination of filaments. Results of tensile testing are listed in Table 3. As far as known, this product is the strongest monofilament (of this size) ever made.

TABLE 3

| Sample | Titer (dtex) | Tenacity (cN/dtex) | Modulus (cN/dtex) | Elongation at break (%) |
|---|---|---|---|---|
| Starting yarn | 25 | 42.7 | 1431 | 3.58 |
| Precursor yarn | 28 | 38.8 | 1225 | 3.45 |
| Example 3 | 19 | 50.2 | 1628 | 3.61 |

The invention claimed is:

1. Process for making a monofilament-like product from a precursor containing at least one strand of fibres made from ultra-high molar mass polyethylene, the process comprising:

a) exposing the precursor to a temperature within the melting point range of the polyethylene for a time sufficient to at least partly fuse adjacent fibres, and b) simultaneously stretching the precursor, wherein step a) includes mechanically compressing the precursor during fusing by passing the precursor over at least one guiding member having a surface comprising a groove.

2. Process according to claim 1, wherein the groove is V-shaped.

3. Process according to claim 1, wherein the precursor is mechanically compressed by passing the precursor over at least 3 guiding members.

4. Process according to claim 1, which comprises controlling the surface of the guiding member at a temperature within the melting point range of the polyethylene.

5. Process according to claim 1, wherein the polyethylene is linear and contains less than 1 mol% of comonomers.

6. Process according to claim 1, wherein the precursor is stretched at a draw ratio of 1.5-10.

7. Process according to claim 1, wherein the strand comprises twisted and/or air-entangled fibres.

8. Process according to claim 1, wherein the polyethylene fibres are substantially free from spin finish.

9. Monofilament-like product comprising at least partially fused fibres made from ultra-high molar mass polyethylene obtained by the process according to claim 1.

10. Monofilament-like product made from UHMWPE fibres, having a titer in the range 5-100 dtex and tenacity of at least 30 cN/dtex.

11. Monofilament-like product from UHMWPE fibres, having a titer of at least 400 dtex and an abrasion resistance of at least 1800 cycles, as determined by a procedure wherein the sample is abraded at room temperature by placing it over a stainless steel eyelet of 1.5 mm diameter at an angle of 90°, which eyelet is submersed in water, and subjecting the sample to oscillating movements at a frequency of 0.5 Hz with a stroke-length of 200 mm, with a constant load of 0.5 kg on the sample, until pilling occurs.

12. Monofilament-like product according to claim 9, having a sheath-core structure with a substantially non-porous ultra-high molar mass polyethylene sheath.

13. Semi-finished products and end-use products comprising the monofilament-like product according to claim 9.

* * * * *